US010695658B2

(12) United States Patent
Almutawa

(10) Patent No.: US 10,695,658 B2
(45) Date of Patent: Jun. 30, 2020

(54) EDUCATIONAL AND SOCIALLY INTERACTIVE LEARNING GAME AND METHOD

(71) Applicant: DAYROFA COMPANY FOR GAMES (W.L.L.), Safat (KW)

(72) Inventor: Alia A. Almutawa, Salwa (KW)

(73) Assignee: Dayrofa Company for Games (W.L.L.), Safat (KW)

( * ) Notice: Subject to any disclaimer, the term of this patent is extended or adjusted under 35 U.S.C. 154(b) by 553 days.

(21) Appl. No.: 14/538,738

(22) Filed: Nov. 11, 2014

(65) Prior Publication Data

US 2016/0129338 A1 May 12, 2016

(51) Int. Cl.
*A63F 3/00* (2006.01)

(52) U.S. Cl.
CPC .. *A63F 3/0052* (2013.01); *A63F 2003/00523* (2013.01)

(58) Field of Classification Search
CPC ..... A63F 3/0003; A63F 3/00006; A63F 3/00072; A63F 3/001; A63F 3/00088; A63F 3/00; A63F 3/04; A63F 3/0023; A63F 3/00895; A63F 2003/0035; A63F 2003/00359; A63F 2003/00381; A63F 3/0052; A63F 2003/00523
USPC ..... 273/258, 260, 262, 283, 284, 243, 287
See application file for complete search history.

(56) References Cited

U.S. PATENT DOCUMENTS

| | | | | | |
|---|---|---|---|---|---|
| 3,414,264 | A | * | 12/1968 | Schriber | A63F 3/00006 273/126 R |
| 3,565,436 | A | * | 2/1971 | Opmeer | A63F 3/00075 273/265 |
| 4,043,559 | A | * | 8/1977 | Eigen | A63F 3/0457 273/236 |
| 4,569,526 | A | * | 2/1986 | Hamilton | A63F 3/00176 273/237 |
| 4,682,956 | A | | 7/1987 | Krane | |
| 4,815,976 | A | | 3/1989 | Krane | |
| 4,872,681 | A | | 10/1989 | Martin | |
| 5,054,775 | A | | 10/1991 | Banks et al. | |
| 5,230,517 | A | | 7/1993 | Peacock | |

(Continued)

FOREIGN PATENT DOCUMENTS

GB 2 126 908 A 4/1984

*Primary Examiner* — Vishu K Mendiratta
(74) *Attorney, Agent, or Firm* — Richard C. Litman; Nath, Goldberg & Meyer

(57) ABSTRACT

The educational and socially interactive learning game includes a plurality of game boards, each game board having different uniquely identifiable indicia; a plurality of sets of game pieces, each game board having a corresponding set in which each game piece has the same identifiable indicia as the corresponding game board; a die having indicia on its faces, each game board having a face of the die bearing its corresponding identifiable indicia; and a plurality of game cards. Each player begins with a game board and corresponding of game pieces. Once the die is cast, the player who cast the die must ask a question eliciting personal information from the player whose game board corresponds to the indicia on the die, or play an educational game with that player. The players then exchange game pieces. The game ends when one player obtains a game piece from each of the other players.

10 Claims, 8 Drawing Sheets

(56) References Cited

U.S. PATENT DOCUMENTS

| | | | | |
|---|---|---|---|---|
| 5,288,076 | A * | 2/1994 | Jackson | A63F 3/00138 273/279 |
| 5,681,046 | A | 10/1997 | Lawrence | |
| 6,267,376 | B1 * | 7/2001 | Jenkins | A63F 3/00006 273/258 |
| 6,926,278 | B2 * | 8/2005 | Bibi | 273/284 |
| 2004/0140614 | A1 | 7/2004 | Kligman | |
| 2006/0033276 | A1 * | 2/2006 | Evans | A63F 3/00 273/259 |
| 2008/0224396 | A1 * | 9/2008 | Cocis | A63F 3/0434 273/157 R |
| 2009/0045572 | A1 * | 2/2009 | Teal | A63F 3/04 273/243 |

* cited by examiner

EDUCATIONAL AND SOCIALLY INTERACTIVE LEARNING GAME AND METHOD

BACKGROUND OF THE INVENTION

1. Field of the Invention

The present invention relates generally to educational games, and more specifically to an educational and socially interactive learning game and method that provides individuals with a chance to converse and to learn about one another in a fun and educational environment.

2. Description of the Related Art

Interactive board games and computer games are considered by many to be enjoyable, educational, and pleasurable social activities. In terms of education, board games have served as a means to develop literacy and language skills. A number of board games and computer games have been developed over the years focusing on social activities, such as games dealing with mystery, strategy, chance, artistic skill, knowledge, and memory. The majority of board games, however, revolve around the idea of competition, where the player or the team to accrue the most points (or money) or move around the board quickest wins the game.

There are other types of games that deal with personal relationships and compatibility. In these games, the players often ask a series of questions and rate one another based on their responses to determine whether they are compatible with the other player or players. However, the scores and ratings given to each of the responses are arbitrary and based solely on the player asking the questions. For example, the same response can be interpreted differently by two different players, and, as such, scored differently by those players. The player who achieves the highest rating(s) is then determined to be most compatible with the player asking the questions.

However, what these board games and computer games fail to provide is an interactive environment in which a group of individuals can learn about each other without having to worry about getting the highest score or achieving the highest and best ratings.

Thus, an interpersonal learning game and method addressing the aforementioned problems is desired.

SUMMARY OF THE INVENTION

The educational and socially interactive learning game includes a plurality of game boards, each having different, uniquely identifiable indicia; a plurality of game pieces, each having different, uniquely identifiable indicia corresponding to the different, uniquely identifiable indicia on each game board; a die having a plurality of faces, each face having different, uniquely identifiable indicia corresponding to the different, uniquely identifiable indicia on each game board; and a plurality of game cards. The game pieces are arranged in different sets according to their different, uniquely identifiable indicia. The different, uniquely identifiable indicia can include different colors, different signs, different symbols, and different numbers. Each player begins with a game board having different, uniquely identifiable indicia (e.g., a different color) and the corresponding set of game pieces having the same identifiable indicia (color) as the game board. Once the die is cast, the player who cast the die must answer a question or play a game with the player whose game board corresponds to the uniquely identifiable indicia on the die. The players then exchange game pieces. Once one player obtains a game piece from each of the other players, the turn is over.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
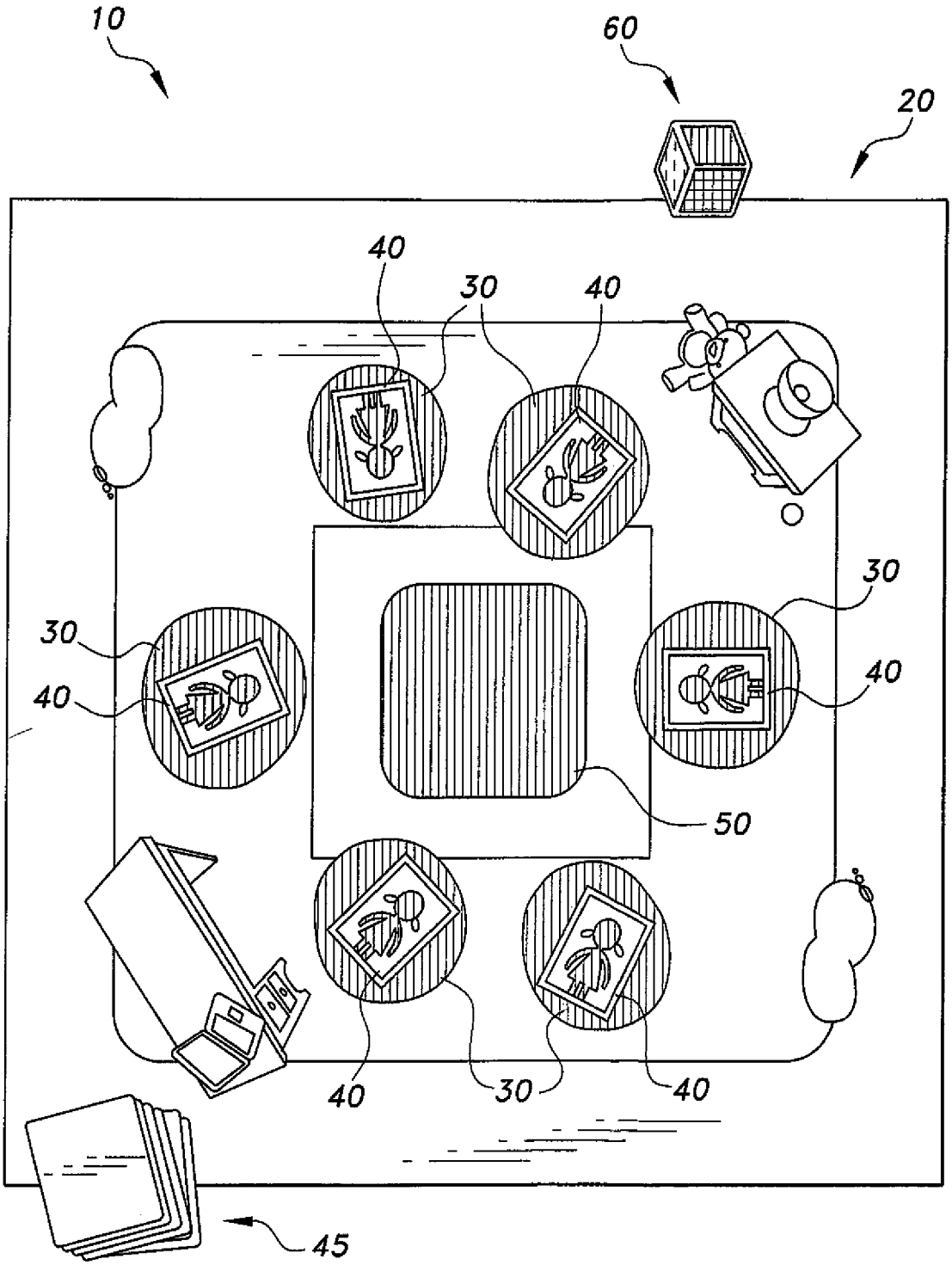
FIG. 1 is an environmental top view of a game board and various components of an educational and socially interactive learning game according to the present invention.
Figure 2:
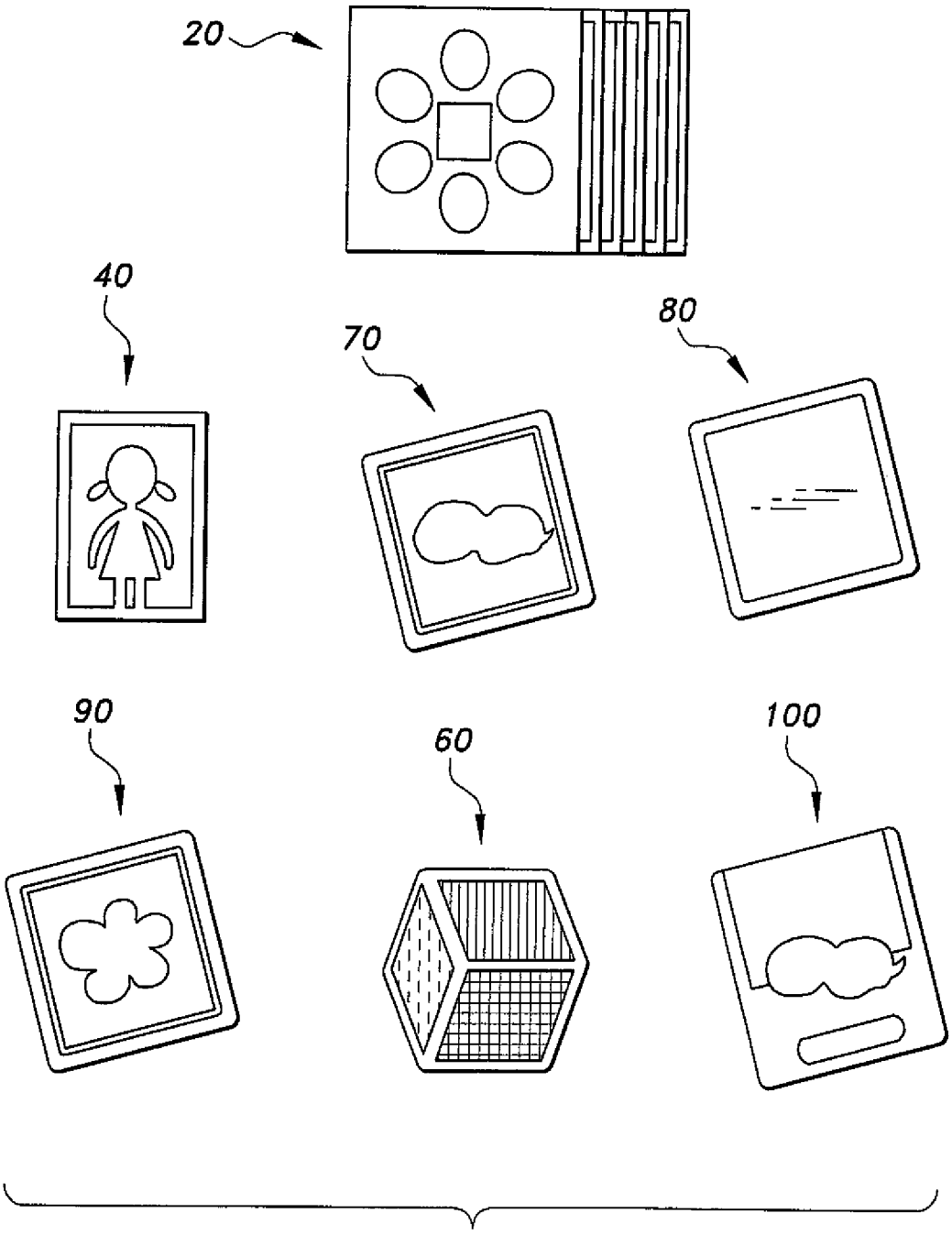
FIG. 2 is a perspective view of various components of an educational and socially interactive learning game according to the present invention.

Referring to FIGS. 1 and 2, the educational and socially interactive learning game 10 is designed for a plurality of players, preferably between three to six players, and uses a plurality of game cards that encourage conversation between players, preferably girls, inviting them to talk about themselves in a fun environment. The game 10 includes a plurality of game boards 20, preferably six, each game board 20 having different, uniquely identifiable indicia 50, preferably indicated on the center of the respective game board 20; a plurality of game pieces 40, preferably a total of thirty-six, each game piece 40 having different, uniquely identifiable indicia corresponding to the different, uniquely identifiable indicia on each respective game board 20; a plurality of game cards, preferably arranged in a single withdrawing deck 45; and a die 60 having a plurality of faces, preferably six, each face having different, uniquely identifiable indicia corresponding to the different, uniquely identifiable indicia on each respective game board 20. It is to be noted that the game 10 can include instructions, which are fully illustrated.

It is to be understood that the game board 20 can be of any suitable size, such as a game board of twelve inches in width and about eight inches in length, although the dimensions of the game board 20 may vary. Further, the corners of the game boards can be of various shapes, such as square corners or corners of a generally square shape, such as illustrated in FIG. 1. The game boards 20 can be formed of any suitable material, such as paper, plastic, tile, or metal. Each game board 20 can have a flat surface in which to display the plurality of locations 30, preferably six, such as chairs, on which to place each game piece 40 of the corresponding set. Additionally, the size of any font on the game board 20 can be one or more different sizes, a variety of sizes, or the same size.

The uniquely identifiable indicia can be different colors, for example. That is, each game board and its corresponding set of game pieces 40 can be color-coded. Accordingly, one face of the die 60 can be blue, another face can be orange, another face can be purple, another face can be pink, another face can be yellow, and another face can be green. Each face of the die 60 will have a different, uniquely identifiable indicia (color) corresponding to the different, uniquely identifiable indicia (color) on each respective game board 20. For example, the pink face of the die 60 will correspond with the pink game board, and the blue face of the die 60 will correspond with the blue game board. Other types of different, uniquely identifiable indicia can include different numbers, different symbols, different signs (such as zodiac signs), or any combination thereof.

Figure 5A:
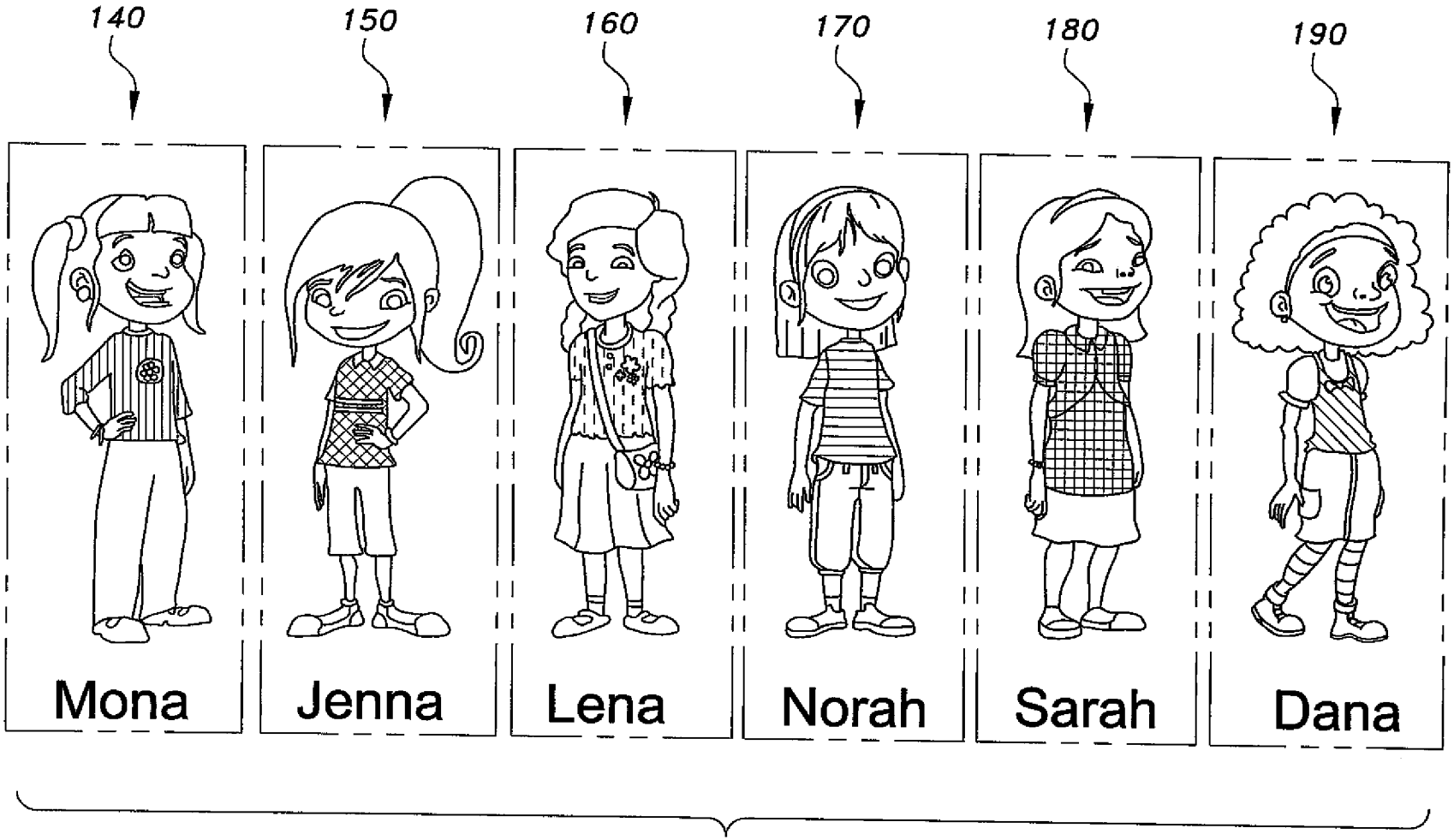
FIG. 5A is a front view of exemplary characters corresponding to the different sets of game pieces and different game boards of an educational and socially interactive learning game according to the present invention.

Referring to FIGS. 1, 2, and 5A, the plurality of game pieces 40 can comprise a plurality of avatars or a plurality of characters, for example. The plurality of game pieces can be arranged in six sets of six individual game pieces 40 (characters), preferably female characters, for a total of thirty-six game pieces. Each game piece 40 within a set has the same identifying indicia, each set of game pieces having a different, uniquely identifiable indicia (color) corresponding to the different uniquely identifiable indicia (color) on each respective game board 20. Each set of game pieces 40 can also have a name associated with it, in addition to its different uniquely identifiable indicia (color). For example, referring to FIG. 5A, the six sets can be named Mona 140, Jenna 150, Lena 160, Norah 170, Sarah 180, and Dana 190, each set having a different uniquely identifiable indicia (color) corresponding to the different uniquely identifiable indicia (color) on each respective game board 20. For example, Mona 140 can be pink and correspond to the pink game board, Jenna 150 can be orange and correspond to the orange game board, Lena 160 can be purple and correspond to the purple game board, Norah 170 can be blue and correspond to the blue game board, Sarah 180 can be yellow and correspond to the yellow game board, and Dana 190 can be green and correspond to the green game board.

Prior to beginning the game, each game piece 40 is arranged in a set according to its different, uniquely identifiable indicia (color). Each set includes game pieces 40 having the same uniquely identifiable indicia (color). For example, each of the blue game pieces form one set, each of the orange game pieces form one set, each of the purple game pieces form one set, each of the pink game pieces form one set, each of the yellow game pieces form one set, and each of the green game pieces form one set.

Figure 5B:
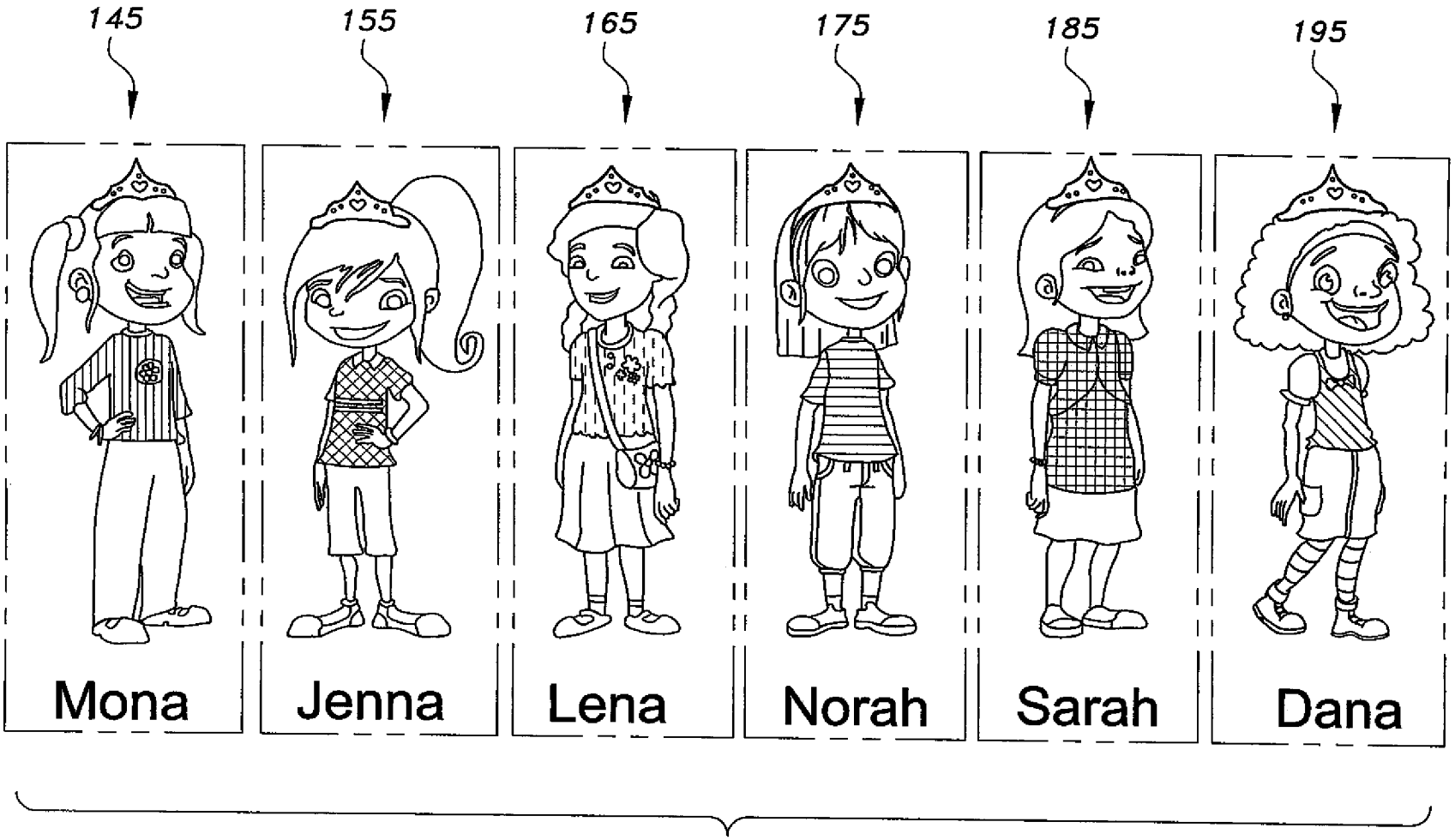
FIG. 5B is a front view of exemplary characters comprising a distinctive feature, such as a tiara, corresponding to the different sets of game pieces and different game boards of an educational and socially interactive learning game according to the present invention.

Once the game pieces 40 have been grouped together according to their different uniquely identifiable indicia (color), they are placed on the game board 20 with the corresponding different uniquely identifiable indicia (color). For example, the set of blue game pieces will be placed on the blue game board, the set of orange game pieces will be placed on the orange game board, the set of purple game pieces will be placed on the purple game board, the set of pink game pieces will be placed on the pink game board, the set of yellow game pieces will be placed on the yellow game board, and the set of green game pieces will be placed on the green game board. As illustrated in FIG. 5B, one game piece 40 within each set will contain a distinctive feature, such as a tiara. For example, referring to FIG. 5B, one game piece 40 in each set will have the distinctive feature, so that one Mona game piece 145, one Jenna game piece 155, one Lena game piece 165, one Norah game piece 175, one Sarah game piece 185, and one Dana game piece 195 will show the tiara or other distinctive feature, each of the distinctive feature game pieces 145, 155, 165, 175, 185, and 195 having a different uniquely identifiable indicia (color) corresponding to the different uniquely identifiable indicia (color) on each respective game board 20. The game piece 145, 155, 165, 175, 185, and 195 with the distinctive feature, such as a tiara, cannot be removed from its respective game board 20.

Figure 3:
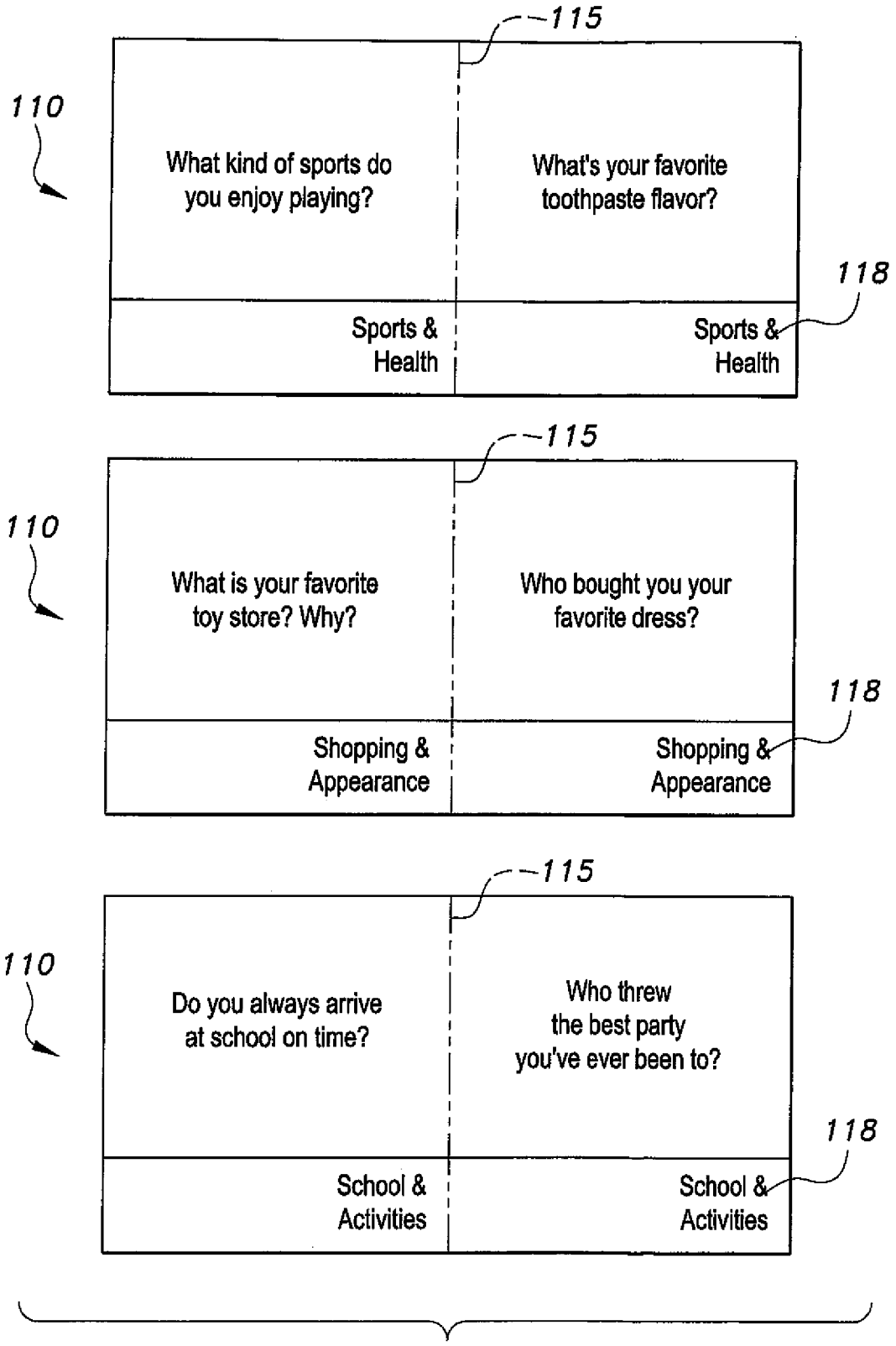
FIG. 3 is a front view of exemplary Talk to Me! Girls™ cards of an educational and socially interactive learning game according to the present invention, showing samples of general categories and personal questions used in the game.

Referring to FIGS. 2, 3, and 4, the plurality of game cards can comprise a variety of distinct subsets of cards. For example, the first distinct subset of cards can be Talk to Me! Girls cards 70, preferably numbering two hundred cards; the second distinct subset of cards can be blank cards 80, preferably numbering twenty-five cards; and the third distinct subset of cards can be Double the Fun! cards 90, preferably numbering fifty cards, which are arranged in a withdrawing deck 45. Each Talk to Me! Girls card 70 has two faces, a front face and a back face. The front face of Talk to Me! Girls cards 70 is typically the side of the card facing the player, while the back face of each Talk to Me! Girls cards 70 is typically the side of the card facing away from the player. The back face of each Talk to Me! Girls card 70 can include the "Talk to Me! Girls™" logo or any other indicia. As shown in FIG. 3, the front face 110 of each Talk to Me! Girls card can include at least one personal question within a general category 118, such as "Sports & Health," "Shopping & Appearance," and "School & Activity," denoted on the lower area of the Talk to Me! Girls card as well as the "Talk to Me! Girls" logo adjacent to the general category and/or adjacent to the personal question. It is contemplated that each face can include additional questions within the same or different general categories. It will be understood that, as used herein, a personal question means a question designed to elicit personal information from the players, such as the player's background, hobbies, avocations (such as sports), acquaintances, vacation trips, and any other activities or interests common to players of that age group. By answering such questions in a group setting, the personal information is shared, fostering common bonds and helping to forge new social relationships.

The two personal questions can be arranged in a variety of ways. For example, one personal question can appear on the front face of the Talk to Me! Girls cards and another personal question can appear on the back face of the Talk to Me! Girls cards. Alternatively, one personal question can appear on the top half of the Talk to Me! Girls card and the other personal question can appear on the bottom half of the Talk to Me! Girls card, or one question can appear of the right-hand side of the Talk to Me! Girls cards and the other personal question can appear on the left-hand side of the Talk to Me! Girls card, as illustrated in FIG. 3. If one question appears on the right-hand side of the Talk to Me! Girls card and the other personal question appears on the left-hand side of the Talk to Me! Girls card 110, as illustrated in FIG. 3, the Talk to Me! Girls card can be folded along the perforated edge 115. Table I illustrates examples of the types of personal questions that can appear on each Talk to Me! Girls card 70.

TABLE 1

Exemplary Talk to Me! Girls card Questions

| Question 1 | Question 2 |
|---|---|
| Do you like ice skating? | Have you ever organized a sports activity for your friends? |
| Who taught you? | Do you know how to play squash? |
| Have you tried a scooter? | Do you prefer bowling or paintball? |
| Where? | What swimming stroke do you use the most, the butterfly, crawl, or breast stroke? |
| Do you exercise on a daily basis? | What's your favorite toothpaste flavor? |
| What type of exercises do you do? | What's your least favorite sport to play? |
| Have you ever flown a kite? | |
| What did it look like? | |
| What kind of sports do you enjoy playing? | |
| Do you know how to do karate? | |
| Name someone you know who does. | |

It should be noted that the questions on the Talk to Me! Girls cards 70 are not limited to personal questions but can include other types of questions, such as educational questions and trivia questions.

Each blank card 80 has two faces, a front face and a back face. The front face of each blank card 80 is typically the side of the card facing the player, while the back face of each blank card 80 is typically the side of the card facing away from the player. Both faces of each blank card 80 can include the "Talk to Me! Girls™" logo on the lower area. Each face of each blank card 80 provides space for a player to introduce their own customized questions.

Figure 4A:
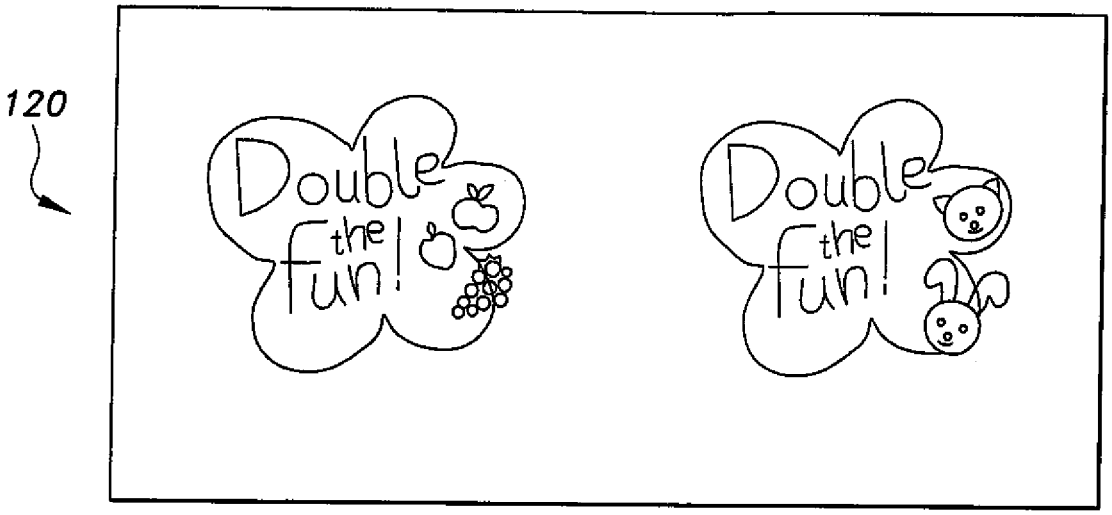
FIG. 4A is a rear view of an exemplary "Double the Fun!" game card of an educational and socially interactive learning game according to the present invention.
Figure 4B:
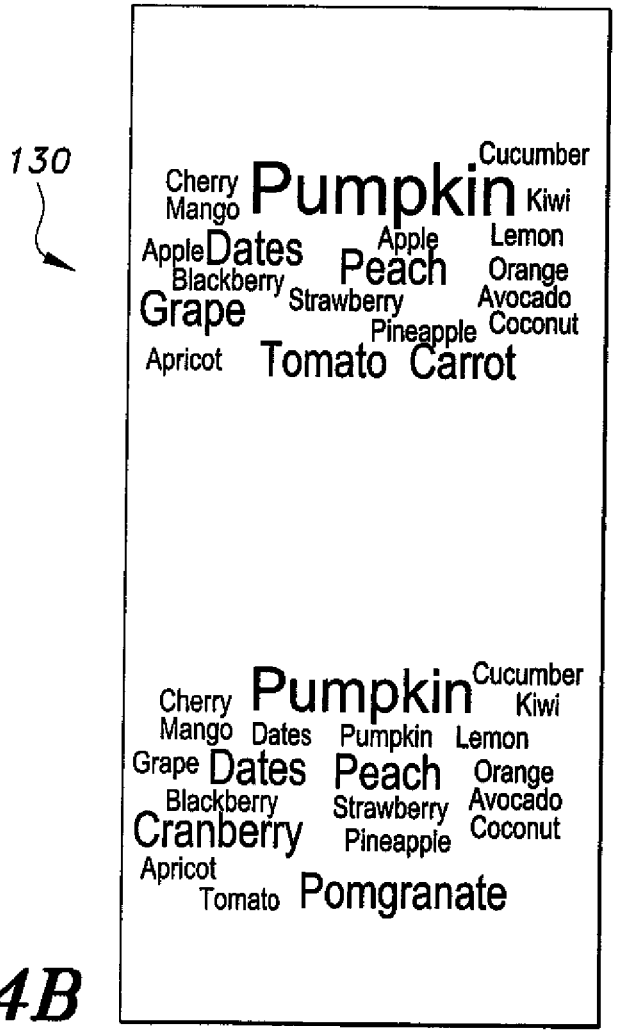
FIG. 4B is a front view of the exemplary "Double the Fun!" game card of FIG. 4A.

Referring to FIGS. 2, 4A, and 4B, each Double the Fun! card 90 has two faces, a front face 130 and a back face 120, the front face 130 and the back face 120 being substantially similar to the "Talk to Me! Girls cards 70 and the blank cards 80 with respect to use orientation. The back face 120 of each Double the Fun! card 90 can include the words "Double the Fun!". The front face 130 of each Double the Fun! card includes an educational puzzle, such as a word search puzzle in which a set of two words is hidden within a variety of other words and the object of the game is to discover the set of two words. It should be noted that the type of puzzle on the front face 130 of the Double the Fun! cards is not limited to word search puzzles, but can include other educational puzzles, such as illustrations, anagrams, ciphers, and crossword puzzles. The back face of the card can include an illustration that represents a classification and/or category, the "Double the Fun" logo, and a sentence that describes what is needed to be done by players.

It is to be understood that the game cards, such as the Talk to Me! Girls cards 70, blank cards 80, and Double the Fun! cards 90, can be of any suitable size, such as a game card having a width of about 2.5 inches and a length of about 3.5 inches, although the size of the Talk to Me! Girls cards 70, blank cards 80, Double the Fun! cards 90 may vary from the above dimensions. Further, the corners of the Talk to Me! Girls cards 70, blank cards 80, and Double the Fun! cards 90 can be of various shapes, such as tapered corners or corners of a generally rounded shape, such as illustrated in FIG. 2. The Talk to Me! Girls cards 70, blank cards 80, and Double the Fun! cards 90 in the withdrawing deck 45 can be formed of any suitable material, such as from paper, plastic, tile, or metal. Each card in the withdrawing deck 45 can have a flat surface on which to display the card's question, puzzle, activity, or combination thereof. Additionally, the size of indicia on the front face or the size of indicia on the back face of the card (the indicia including, for example, the question, puzzle, activity, or combination thereof, as displayed on a card from the withdrawing deck 45) can be one or more different sizes, a variety of sizes, or the same size, for example.

Figure 6A:
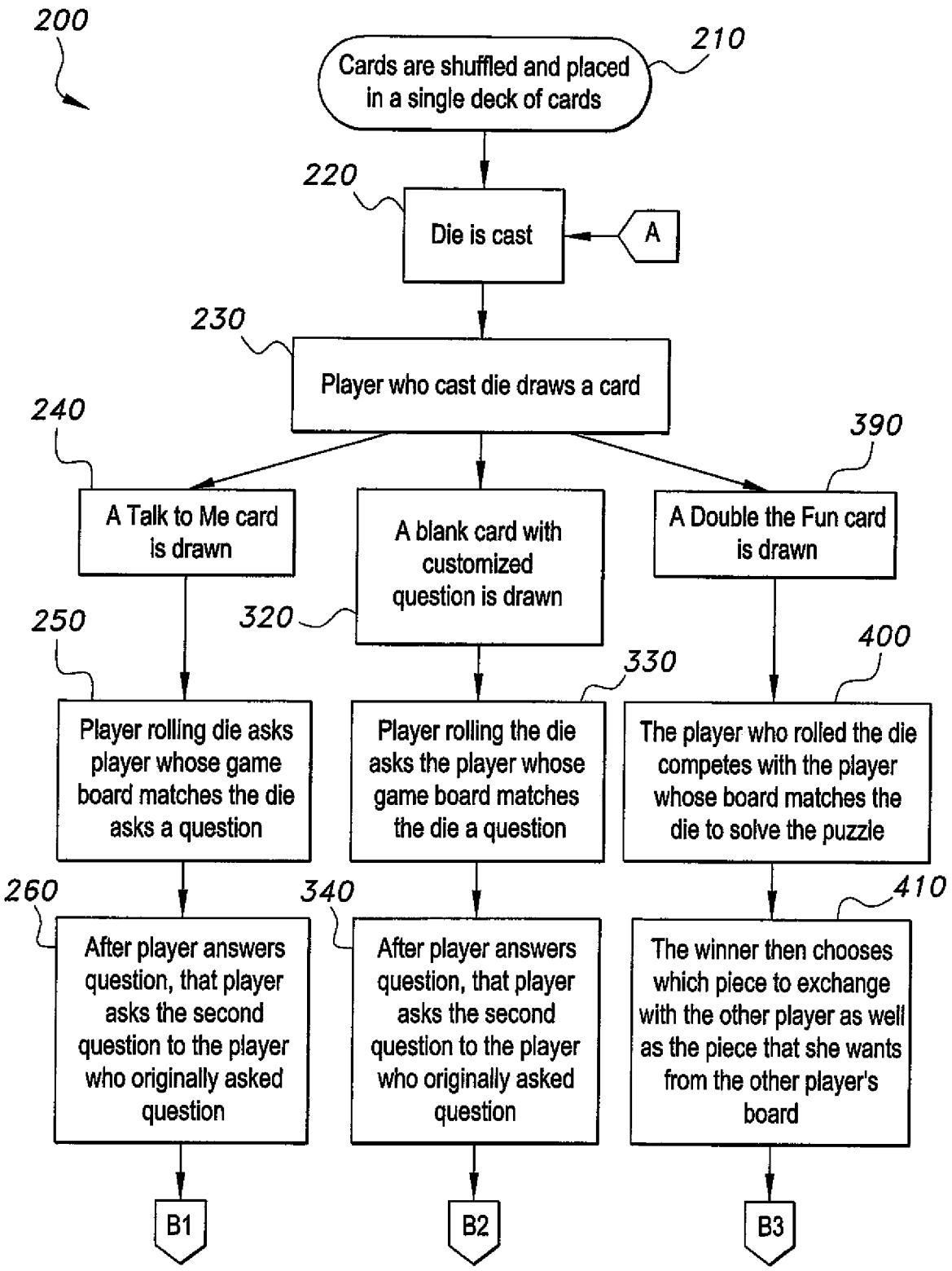
FIG. 6A is a flowchart illustrating steps of a method for playing an educational and socially interactive learning game according to the present invention.
Figure 6B:
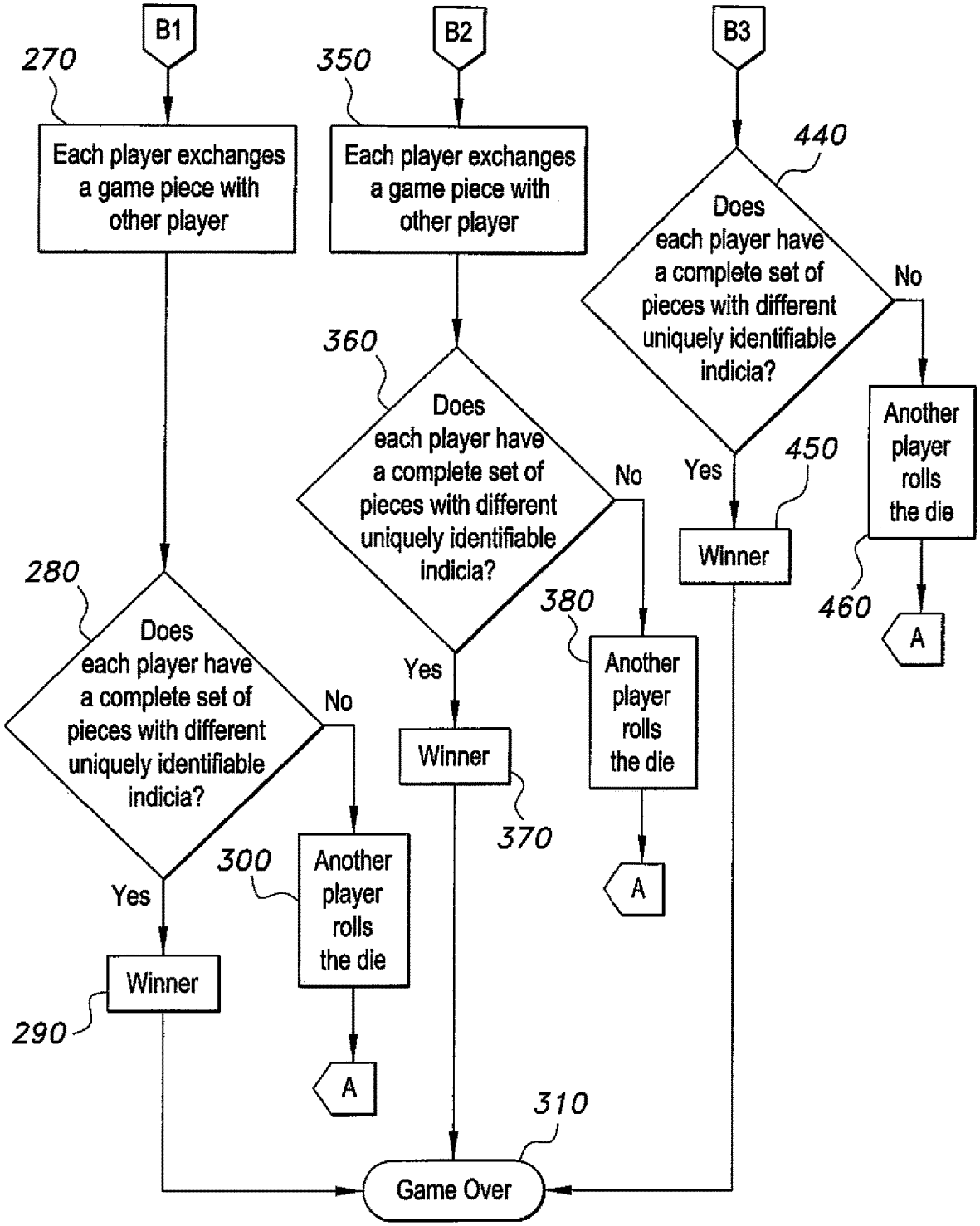
FIG. 6B is a flowchart illustrating steps of a method for playing an educational and socially interactive learning game according to the present invention.

Referring to FIGS. 1, 6A and 6B, to play the game, each game piece 40 must be grouped together by their different uniquely identifiable indicia (color) to form a complete set of game pieces 40 with the same uniquely identifiable indicia (color). Each player then chooses a game board 20 having different uniquely identifiable indicia (color). After selecting a game board 20, the player must place the complete set of game pieces 40 having the same different uniquely identifiable indicia (color) as the game board 20, as illustrated in FIG. 1. If the number of players is less than the total number of game boards, only the number of game boards and corresponding number of sets of game pieces are selected. For example, if there four players, only four game boards and the four corresponding sets of game pieces will be used. Accordingly, if two of the unused game boards are the yellow game board and the blue game board then the yellow set of game pieces and the blue set of game pieces will remain unused.

As shown in the flowchart 100 of FIG. 6A, after the game boards 20 and the corresponding sets of game pieces 40 have been arranged for each player, the games cards (comprising a variety of distinct subsets of cards, such as the Talk to Me! Girls cards 70 and the Double the Fun! cards 90) are shuffled together (step 210). If the players choose to use the blank cards 80 to write customized questions, the blank cards 80 are also mixed in with the Talk to Me! Girls cards 70 and the Double the Fun! cards 90. Once all the cards have been mixed together and shuffled, the withdrawing deck 45 can be placed within reach of all players. Once the die 60 is cast (step 220), the player randomly picks a card (step 230). The card selected can be either a Talk to Me! Girls card 70, a blank card 80 with customized questions, or a Double the Fun! card 90. The type of card selected will determine the next step in the game.

There are a plurality of ways to determine the order in which the players will cast the die 60. Preferably, the youngest player will roll first. When the die is cast (step 220), if the different uniquely identifiable indicia (color) rolled corresponds to the indicia (color) of an unused game board 20, the player will roll again. If the different uniquely identifiable indicia (color) rolled corresponds to the indicia (color) of the respective game board 20 of the player casting the die 60, the player will roll again. Once the die 60 is cast and the indicia (color) corresponds to another player's game board 20, the player who cast the die 60 will draw a card (step 230).

If a Talk to Me! Girls card is drawn (step 240), the player chooses one of the two questions appearing on the Talk to Me! Girls card 70. The player then reads the chosen question aloud (step 250) to the player whose game board corresponds to the indicia (color) on the die 60. After the player who possesses the game board with the indicia (color) corresponding to the indicia (color) on the die 60 answers the question, that player takes the Talk to Me! Girls card 70 from the player asking the question. The player whose turn it was to originally answer the question then reads the other question appearing on the Talk to Me! Girls card 70 to the player who originally asked the question (step 260). Once both players have answered their respective questions, each player exchanges one of the game pieces 40 on their game board 20 with the other player (step 270). For example, if the player using the blue game board 20 rolls the color pink, the player using the pink game board 20 must answer a question. After the player using the pink game board 20 answers the question, the player using the pink game board 20 can ask the player using the blue game board 20 the other question appearing on the Talk to Me! Girls card 70. After the players have answered their respective questions, the player using the pink game board 20 exchanges a game piece 40 from the pink game board 20 with the player using the blue game board 20, and the player using the blue game board 20 exchanges a game piece 40 from the blue game board 20 with the player using the pink game board 20. Each player can choose which game piece 40 to give to the other player. If the players do not feel comfortable answering one of the questions on the card 70, the player asking the question can draw another card 70 from the withdrawing deck 45. After the players have exchanged game pieces 40, the players must determine if they have a complete set of game pieces 40 with different uniquely identifiable indicia from each of the other players (step 280). If a player has a complete set of game pieces 40 with different uniquely identifiable indicia from each of the other players, that player is the winner (step 290) and the game is over (step 310). If neither player has a complete set of game pieces 40 with different uniquely identifiable indicia from each of the other players, another player rolls the die (step 300).

If a blank card 80 containing customized questions is drawn (step 320), the player reads the question aloud (step 330) to the player whose game board 20 has the different uniquely identifiable indicia (color) corresponding to the different uniquely identifiable indicia (color) on the die 60. After the player whose game board 20 possesses the different uniquely identifiable indicia (color) corresponding with the different uniquely identifiable indicia (color) on the die 60 answers the question, that player takes the Talk to Me! Card 70 from the player asking the question. The player whose turn it was to originally answer the question then reads the other question appearing on the front face of the blank card 80 to the player who originally asked the question 340. If there is only one question on the blank card 80, then the player whose turn it is to ask a question will draw a card and ask the question appearing on the Talk to Me! card 70 or play the game on the Double the Fun! card (step 340). Once both players have answered their respective questions, each player exchanges one of the game pieces 40 on their game board 20 with the other player (step 350). For example, if the player using the blue game board 20 rolls the color pink, the player using the pink game board 20 must answer a question. After the player using the pink game board 20 answers the question, the player using the pink board 20 must read the second question on the blank card 80 to the player using the blue game board 20, or, if there is only one question on the blank card 80, then selects a card and, regardless of whether it is a Talk to Me! Girls card 70 or a blank card 80 containing a customized question, can ask the player using the blue game board 20 a question appearing on the front face of the card. After the players have answered their respective questions, the player using the pink game board 20 exchanges a game piece 40 from the pink game board 20 with a game piece 40 from the player using the blue game board 20. Each player can choose which game piece 40 to exchange with the other player. If the players do not feel comfortable answering one of the questions on the card, the player asking the question can draw another card from the withdrawing deck 45. After the players have exchanged game pieces 40, the players must determine if they have a complete set of game pieces 40 with different uniquely identifiable indicia from each of the other players (step 360). If a player has a complete set of game pieces 40 with different uniquely identifiable indicia from each of the other players, that player is the winner (step 370) and the game is over (step 310). If neither player has a complete set of game pieces 40 with different uniquely identifiable indicia from each of the other players, another player rolls the die 60 (step 380).

If a Double the Fun! card 90 is drawn (step 390), the player who drew the card must place the Double the Fun! card 90 where it can be seen by both the player who cast the die 60 and the player whose game board 20 contains the different uniquely identifiable indicia (color) corresponding with the different uniquely identifiable indicia (color) on the die 60. Then there is a competition to determine which of the two players is the fastest at solving the puzzle (step 400). The player who solves the puzzle first can then choose any piece 40 from the other player's game board 20 and exchange it with a piece 40 from the winner's own game board 20, chosen by the winner (step 410), as opposed to allowing the other player to choose the game piece 40, as in the case of the Talk to Me! Girls cards 70 or the blank cards 80. For example, if the player with the blue game board 20 rolls the color pink, the player with the pink game board 20 must compete with the player with the blue game board 20 to see which player completes the puzzle first. If the player with the pink game board 20 wins, the player with the pink game board 20 chooses which game piece 40 on the blue game board 20 the player with the pink board 20 wants from the player with the blue game board 20, and the player with the pink game board 20 also chooses which game piece 40 on the pink game board 20 to exchange with the player using the blue game board 20. After the Double the Fun! card activity, the players can choose to talk about a favorite subject or memory that the Double the Fun! card 90 brings to mind. After the players have exchanged game pieces 40, the players must determine if they have a complete set of game pieces 40 with different uniquely identifiable indicia (step 440) from each of the other players. If a player has a complete set of game pieces 40 with different uniquely identifiable indicia from each of the other players, that player is the winner (step 450) and the game is over (step 310). If neither player has a complete set of game pieces 40 with different uniquely identifiable indicia from each of the other players, another player rolls the die (step 460).

After both players answer the questions or complete the activity on the Double the Fun! cards 90 and it is determined that neither player has a complete set of game pieces 40 with different uniquely identifiable indicia from each of the other players, the game continues, preferably in the clockwise direction, to the next player. The players continue to play and exchange game pieces 40 until one player has a game board 20 having a game piece 40 including the distinctive feature, such as a tiara, as well as a game piece 40 from each of the other players to form a complete set of game pieces 40, each having different uniquely identifiable indicia (color). For example, if all six game boards 20 are being used and different colors, such as blue, orange, purple, pink, yellow, and green, are being used as the uniquely identifiable indicia, and the player having the blue game board is the winner, his or her game board 20 will contain the blue game piece 40 having the distinctive feature, such as a tiara, in addition to an orange game piece 40, a purple game piece 40, a pink game piece 40, a yellow game piece 40, and a green game piece 40, and the game is over.

It is to be noted that if there are less than six players, the winning player will be the one who fills the locations 30 on his or her game board 20 with a game piece 40 from each of the other players, in addition to a first winning player's game piece 40 having the distinctive feature (such as a tiara) and an additional winning player's game piece 40 on the location (s) 30 for the missing player(s). For example, if there are only five players, then the game board 20 of the winning player will contain a game piece 40 from each of the other four players, in addition to a first winning player's game piece 40 having the distinctive feature, such as a tiara, and an additional second winning player's game piece 40 on the location 30 for the missing player. Further, if there are only four players playing, the game board 20 of the winning player will contain a game piece 40 from each of the other three players, in addition to a first winning player's game piece 40 having the distinctive feature, such as a tiara, and additional second and third winning player's game pieces 40 on the two locations 30 for the two missing players. If, however, there are only three players, the game board 20 of the winning player will contain a total of six game pieces 40 including two game pieces 40 from each of the other two players, a first winning player's game piece 40 having the distinctive feature, such as a tiara, and an additional second winning player's game piece 40. It is to be noted that the game 10 can also be played with only two players. However, in the event that only two players play the game 10, there will not be a winning player.

An alternative embodiment of the socially interactive and educational learning game is designed for a plurality of people, preferably between eighteen and thirty-six people, and uses a plurality of game cards that encourage conversation between groups of people inviting them to talk about themselves in a fun environment. The alternative embodiment is substantially similar to the embodiment described above. The difference between the embodiment described above and the alternative embodiment is that a game piece 40 and a member of a team are exchanged for a game piece 40 and a member of another team after the questions on the Talk to Me! Girls card 70 or blank card 80 has been answered or the puzzle on the Double the Fun! card 90 has been completed.

To play the game using a plurality of people, the people can be grouped into separate teams, each preferably having six team members with each team arranged around a table. Each team can have a different uniquely identifiable indicia corresponding to the different uniquely identifiable indicia on a game board 20. For example, if there is a pink game board, a blue game board, and a yellow game board, there will be a pink team, blue team, and a yellow team, each team member having a different uniquely identifiable indicia (color) corresponding to the different uniquely identifiable indicia on each respective game board 20. For example, each member of the pink team will wear an item, such as a ribbon or a balloon, for example, comprising the color pink and each member of the blue team will wear an item, such as a ribbon or a balloon, for example, comprising the color blue.

Preferably the plurality of tables will be arranged in a circle. Each team will be located around the table with the game board 20 and set of game pieces 40 having the corresponding different uniquely identifiable indicia (color) as the team. For example, each member of the pink team is seated around the table with the pink game board and corresponding set of pink game pieces and each member of the blue team is seated around the table with the blue game board and the corresponding set of blue game pieces. Prior to commencing the game, each team selects a team leader who represents the piece with the distinctive feature, such as a tiara, and cannot move from the table.

If the number of teams is less than the total number of game boards 20, only the number of game boards 20 and the number of sets of pieces 40 corresponding to the number of teams is selected. For example, if there are thirty-six people, there will be six teams, and thus, six game boards and six sets of game pieces will be used. If, however, there are twenty-four people, there will only be four teams, and thus, four game boards and four sets of game pieces will be used. Accordingly, if the two unused game boards are the yellow game board and the blue game board, then the yellow set of game pieces and the blue set of game pieces, respectively, will remain unused.

After the game boards 20 and corresponding set of game pieces 40 have been placed on the tables with the corresponding different uniquely identifiable indicia (color) and the teams have been arranged around the tables with the corresponding different uniquely identifiable indicia (color), the game cards having a variety of distinct subsets of cards, such as the Talk to Me! Girls cards 70 and the Double the Fun! cards 90, are shuffled together in a single withdrawing deck 45. If the teams choose to use the blank cards 80 to write customized questions, the blank cards 80 are also mixed in with the Talk to Me! Girls cards 70 and Double the Fun! cards 90. The cards are then shuffled 210. There are a plurality of ways to determine who will cast the die for each team. It is preferable that the respective team leaders cast the die 60 for their teams.

There are a plurality of ways to determine the order in which the teams will role the die 60. It is preferable that the team with youngest player roll first. Once the die 60 is cast so that the uniquely identifiable indicia (color) corresponds to another team's game board 20, the team who cast the die 60 will draw a card. There are a plurality of ways to determine which team member will choose the first game card and ask the first question. It is preferable that the youngest player on the team draw the first game card. The card selected can be either a Talk to Me! Girls card 70, a blank card with a customized question 80, or a Double the Fun! card 90. The type of card selected will determine the next step in the game.

Once the teams have answered the questions on the Talk to Me! Girls card 70 or blank cards 80 or have competed the puzzle on the Double the Fun! card 90, a team member and corresponding game piece 40 from their game board 20 is exchanged with a team member and corresponding game piece 40 from the other team's game board 20. For example, if the blue team rolls the color pink, a player on the team with the pink game board must answer a question. After the player on the team with the pink game board answers the question, the player on the team with the pink board can ask the player on the team with the blue game board the other question appearing on the front face (or on the back face, if the questions are on opposite faces of the card 70) of the Talk to Me! Girls card 70. After the players have answered their respective questions, the team with the blue board exchanges a team member and corresponding game piece with a team member and corresponding game piece from the team with the pink game board. Each team can choose which team member and corresponding game piece to exchange with the other team. If the players do not feel comfortable answering one of the questions on the card, the player asking the question can draw another card from the deck of cards 45.

If a player on the team draws a Double the Fun! card 90 (step 390), the player who drew the card must place the Double the Fun! card 90 where it can be seen both by the team whose player cast the die 60, and by the team whose game board 20 contains the different uniquely identifiable indicia (color) corresponding with the different uniquely identifiable indicia (color) on the die 60. Then there is a competition to determine which of the two teams is the fastest at solving the puzzle (step 400). The team that solves the puzzle first can then choose any team member and corresponding game piece 40 from the other team's table and corresponding game board 20, and exchange it with a team member and corresponding game piece 40 from the winning team's own table and corresponding game board 20 chosen by the winning team (step 410), as opposed to allowing the other team to choose the team player and corresponding game piece 40, as in the case of the Talk to Me! Girls cards 70 or the blank cards 80. For example, if the player from the blue team with the blue game board 20 rolls the color pink, the team with the pink game board 20 must compete with the team with the blue game board 20 to see which team completes the puzzle first. If the team with the pink game board 20 wins, the team with the pink game board 20 chooses which team member and corresponding game piece 40 from the blue table and corresponding blue game board 20 that the team with the pink board 20 wants from the team with the blue game board 20, and the team with the pink game board 20 also chooses which team member and corresponding game piece 40 on the pink game board 20 to exchange with the team using the blue game board 20. After the Double the Fun! card activity, the teams can choose to talk about a favorite subject or memory that the Double the Fun! card 90 brings to mind. After the teams have exchanged game pieces 40, the teams must determine if they have a complete set of team members and corresponding game pieces 40 with different uniquely identifiable indicia (step 440) from each of the other teams. If a team has a complete set of team members and corresponding game pieces 40 with different uniquely identifiable indicia from each of the other teams, that team is the winner (step 450) and the game is over (step 310). If neither team has a complete set of team members and corresponding game pieces 40 with different uniquely identifiable indicia from each of the other teams, another player from another team rolls the die (step 460). It is desirable that the game proceed in a clockwise direction.

The teams continue to play and exchange team members and corresponding game pieces until one team leader has a team member and corresponding game piece, each having a different uniquely identifiable indicia (color) from each of the other teams. For example, if all six game boards are being used and different colors, such as blue, orange, purple, pink, yellow, and green, are being used as the uniquely identifiable indicia, and the blue team leader is to win, the blue team leader must have a team member and corresponding game piece from the orange team, a team member and corresponding game piece from the purple team, a team member and corresponding game piece from the pink team, a team member and corresponding game piece from the yellow team, and a team member and corresponding game piece from the green team. The game is then over and the winner is the blue table with the team leader from the blue team.

Although the game has been described in terms of game boards 20 and corresponding sets of game pieces 40, it will be appreciated that other embodiments of the socially interactive and educational learning game and method for playing the personal information sharing game can be applied to a computer game or gaming device, such as a mobile device, in which various types of questions and the instructions for playing the personal information sharing game can be stored in a memory of a computer-implemented device and can be implemented by the computer-implemented device. The implementation can be in the form of a program that can include applications or other software that can be downloaded or stored on a hard drive, DVD, CD Rom or other recordable media. Further, it is to be noted that the personal information sharing game and the questions of the game can be generated at random by the computer-implemented device and can be displayed as images on a digital screen associated with the computer-implemented device, such as displays on a personal computer, smart phone, tablet, or any other type of digital or electronic device. The types of questions and game pieces can therefore also be a set of virtual "questions" and virtual "avatars" in such embodiments, and the computer application includes hardware, such as processors and non-transitory memory, and software for adapting and implementing the processes and methods of FIGS. 6A and 6B as an example of an algorithm in a computer-implemented application in playing the personal information sharing game.

For example, when the die is cast and the card is chosen in a computer or digital game, the human player can interact with various other players in various locations through a networking system, such as a local or global computer communication system.

Therefore, embodiments of the socially interactive and educational learning game provide game apparatus and methods for playing a card game that are typically relatively simple and versatile so that players of various ages can enjoy the personal information sharing game and benefit therefrom. Additional embodiments of the personal information sharing game can provide for several language versions of the card game. Other embodiments of the personal information sharing game can provide for several ranks of the card game, such as family, college and party versions.

Further, embodiments of the socially interactive and educational learning game can provide a versatile personal information sharing game that can be played through a variety of different methods, such as paper cards, digital & computer mediums, including smart phones, tiles and the like.

It is to be understood that the present invention is not limited to the embodiments described above, but encompasses any and all embodiments within the scope of the following claims.

I claim:

1. An educational and socially interactive learning game, comprising:

at least three separate and distinct game boards, each of the at least three separate and distinct game boards having a different uniquely identifiable indicia, each of the at least three separate and distinct game boards being exposed simultaneously on a surface for simultaneous play;

at least three sets of game pieces, each of the at least three sets of game pieces having at least three individual game pieces bearing the uniquely identifiable indicia of one of the at least three separate and distinct game boards;

wherein at least one of the game pieces of each of the at least three sets of game pieces includes a game piece having a distinctive feature;

a die having at least three faces, each of the at least three faces having a different uniquely identifiable indicia thereon, the uniquely identifiable indicia displayed on each of the at least three faces corresponding to the uniquely identifiable indicia displayed on one of the at least three separate and distinct game boards;

wherein each separate and distinct game board identified by the respective uniquely identifiable indicia and each of the at least three sets of game pieces corresponding to one of the at least three separate and distinct game boards identified by the respective uniquely identifiable indicia being associated as a group independent from the remaining separate and distinct game boards and corresponding sets of game pieces; and a plurality of game cards including a distinct first subset of game cards, each of the game cards of the first subset of game cards having at least one question displayed thereon, a distinct second subset of game cards, each of the game cards of the second subset of game cards having a puzzle displayed thereon, and a distinct third subset of game cards, each of the game cards of the third subset of game cards having a blank area displayed thereon.

2. The educational and socially interactive learning game according to claim 1, wherein the at least three individual game pieces of the at least three sets of game pieces comprises a plurality of people.

3. The educational and socially interactive learning game according to claim 1, wherein the different uniquely identifiable indicia is selected from the group consisting of colors, symbols, numbers, signs, or any combination thereof.

4. The educational and socially interactive learning game according to claim 1, wherein the questions displayed on the first subset of cards include questions seeking personal information.

5. The educational and socially interactive learning game according to claim 1, wherein the questions displayed on the first subset of cards include trivia questions.

6. The educational and socially interactive learning game according to claim 1, wherein the questions displayed on the first subset of cards include educational questions.

7. The educational and socially interactive learning game according to claim 1, wherein each card in the first subset of cards has general category indicia thereon.

8. The educational and socially interactive learning game according to claim 1, wherein the puzzle displayed on the second subset of cards selected from the group consisting of word search puzzles, anagrams, ciphers, and crossword puzzles.

9. An educational and socially interactive learning game, consisting of:

at least three separate and distinct game boards, each of the at least three separate and distinct game boards having a different uniquely identifiable indicia, each of the at least three separate and distinct game boards being exposed simultaneously on a surface for simultaneous play;

at least three sets of game pieces, each of the at least three sets of game pieces having at least three individual game pieces bearing the uniquely identifiable indicia of one of the at least three separate and distinct game boards;

wherein at least one of the game pieces of each of the at least three sets of game pieces includes a game piece having a distinctive feature;

a die having at least three faces, each of the at least three faces having a different uniquely identifiable indicia thereon, the uniquely identifiable indicia displayed on each of the at least three faces corresponding to the uniquely identifiable indicia displayed on one of the at least three separate and distinct game boards;

wherein each game board identified by the respective uniquely identifiable indicia and each of the at least three sets of game pieces corresponding to one of the at least three separate and distinct game boards identified by the respective uniquely identifiable indicia being associated as a group independent from the remaining separate and distinct game boards and corresponding sets of game pieces;

wherein the different uniquely identifiable indicia is selected from the group consisting of colors, symbols, numbers, signs, or any combination thereof; and a plurality of game cards including a distinct first subset of game cards, each of the game cards of the first subset of game cards having at least one question displayed thereon, a distinct second subset of game cards, each of the game cards of the second subset of game cards having a puzzle displayed thereon, and a distinct third subset of game cards, each of the game cards of the third subset of game cards having a blank area displayed thereon.

10. An educational and socially interactive learning game, comprising:

at least three separate and distinct game boards, each of the separate and distinct game boards having a different uniquely identifiable indicia, each of the at least three separate and distinct game boards being exposed simultaneously on a surface for simultaneous play;

at least three sets of game pieces, each of the at least three sets of game pieces having at least three individual game pieces bearing the uniquely identifiable indicia of one of the at least three separate and distinct game boards;

wherein at least one of the game pieces of each of the at least three sets of game pieces includes a game piece having a distinctive feature;

a die having at least three faces, each of the at least three faces having a different uniquely identifiable indicia thereon, the uniquely identifiable indicia displayed on each of the at least three faces corresponding to the uniquely identifiable indicia displayed on one of the at least three separate and distinct game boards;

wherein each separate and distinct game board identified by the respective uniquely identifiable indicia and each one of the at least three individual game pieces of the at least three sets of game pieces corresponding to one of the at least three separate and distinct game boards identified by the respective uniquely identifiable indicia being associated as a group independent from the remaining separate and distinct game boards and corresponding sets of game pieces;

wherein the different uniquely identifiable indicia is selected from the group consisting of colors, symbols, numbers, signs, or any combination thereof;

whereby the uniquely identifiable indicia of each of the at least three faces is associated specifically with the one of the at least three separate and distinct game boards also having the respective uniquely identifiable indicia; and a plurality of game cards consisting of:

a distinct first subset of cards, each of the cards of the first subset of cards having at least one question and a general category indicia displayed thereon;

wherein the questions displayed on the first subset of cards being selected from the group of questions consisting of seeking personal information, trivial information, and educational information;

a distinct second subset of cards, each of the cards of the second subset of cards having a puzzle displayed thereon, the puzzle displayed on the second subset of cards selected from the group consisting of word search puzzles, anagrams, ciphers, and crossword puzzles; and a distinct third subset of cards, each of the cards of the third subset of cards having a area for selective indicia to be displayed thereon.

* * * * *